US011377895B2

(12) United States Patent
Cohen

(10) Patent No.: US 11,377,895 B2
(45) Date of Patent: Jul. 5, 2022

(54) DOOR OPERATOR HAVING AN AUTOMATED ROLLER

(71) Applicant: Jason Cohen, Delray Beach, FL (US)

(72) Inventor: Jason Cohen, Delray Beach, FL (US)

( * ) Notice: Subject to any disclaimer, the term of this patent is extended or adjusted under 35 U.S.C. 154(b) by 46 days.

(21) Appl. No.: 16/932,762

(22) Filed: Jul. 19, 2020

(65) Prior Publication Data

US 2021/0017802 A1 Jan. 21, 2021

Related U.S. Application Data

(60) Provisional application No. 62/876,230, filed on Jul. 19, 2019.

(51) Int. Cl.
*E05F 11/00* (2006.01)
*E05F 15/624* (2015.01)
*E05F 5/02* (2006.01)

(52) U.S. Cl.
CPC ..... *E05F 15/624* (2015.01); *E05F 5/02* (2013.01); *E05Y 2900/132* (2013.01)

(58) Field of Classification Search
CPC . E05F 15/624; E05F 5/02; E05F 15/77; E05F 5/06; E05Y 2600/13; E05Y 2800/205; E05Y 2900/132; E05Y 2201/448; E05Y 2600/528
USPC ..... 49/358
See application file for complete search history.

(56) References Cited

U.S. PATENT DOCUMENTS 1,694,431 A * 12/1928 Russell ..... E05F 15/624 49/358
2,827,284 A * 3/1958 Bunzl ..... E05F 15/624 49/32
5,583,405 A * 12/1996 Sai ..... G01S 15/876 318/286
5,878,530 A * 3/1999 Eccleston ..... E05F 15/77 49/139
7,021,005 B1 * 4/2006 Curry ..... E05F 15/624 49/358
8,390,219 B2 * 3/2013 Houser ..... E05F 15/63 318/255
9,725,941 B2 * 8/2017 Van Tassell, III ..... E05F 15/60
10,081,977 B2 * 9/2018 Shelley ..... E05F 15/611
10,911,224 B1 * 2/2021 Marappan ..... H04L 9/0819
(Continued)

FOREIGN PATENT DOCUMENTS

DE 102017130881 A1 * 6/2019 ..... E05F 15/60
KR 20180067365 A * 6/2018
WO WO-2017195197 A1 * 11/2017 ..... E05F 15/624

*Primary Examiner* — Jerry E Redman
(74) *Attorney, Agent, or Firm* — Allen F. Bennett; Bennett Intellectual Property

(57) ABSTRACT

A door operator having an automatic roller closes and opens a door attached to a doorjamb by a door hinge. The roller is actuated by a motor and housed within a protective roller casing affixed to the bottom of a door. The door operator may be integrated with a smart home, thereby allowing a user to close and open a door by voice command. The door operator may be retrofitted to existing doors. A door may also be modified such that only a magnet holds the door closed and a closed position such that the smart home door closing apparatus may be used to open a door. The roller may translate between an extended position engaging the floor below a door and a retracted position above the floor, either inside or adjacent to the door itself.

10 Claims, 8 Drawing Sheets

(56) References Cited

U.S. PATENT DOCUMENTS

| | | | | |
|---|---|---|---|---|
| 11,002,061 | B1 * | 5/2021 | Maiga | E05B 47/026 |
| 11,136,812 | B2 * | 10/2021 | Rabinowitz | E05F 15/624 |
| 2002/0175827 | A1 * | 11/2002 | Klein | G08C 17/02 340/4.11 |
| 2010/0115853 | A1 * | 5/2010 | Gebhart | H02P 6/085 49/506 |
| 2012/0272576 | A1 * | 11/2012 | Van Tassell, III | E05F 15/77 49/70 |
| 2013/0145692 | A1 * | 6/2013 | Laird | E05F 15/73 49/31 |
| 2013/0318878 | A1 * | 12/2013 | Manseder | E05F 15/624 49/358 |
| 2013/0326960 | A1 * | 12/2013 | Manseder | E05F 15/624 49/358 |
| 2018/0058130 | A1 * | 3/2018 | Shelley | E05F 15/624 |
| 2018/0298642 | A1 * | 10/2018 | Tagtow | E05B 47/026 |
| 2021/0017802 | A1 * | 1/2021 | Cohen | E05F 15/77 |
| 2021/0317697 | A1 * | 10/2021 | Tulsidas | G06K 9/00288 |

* cited by examiner

DOOR OPERATOR HAVING AN AUTOMATED ROLLER

CROSS-REFERENCE TO RELATED APPLICATIONS

This application claims priority to U.S. Provisional Application Ser. No. 62/876,230 filed on Jul. 19, 2019, the contents of which are incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

Copyright Notice

Not Applicable

BACKGROUND OF THE INVENTION

Field of the Invention

The present invention relates to a door opening and closing device that may be integrated into a smart home. More particularly, the invention relates to an automatic roller attachable to the bottom of a door that may be activated to open or close the door upon command.

Description of the Related Art

Door opening and closing devices are frequently found in airports, malls, supermarkets and other locations where manual operation of the door may be inconvenient to users. Many door operators are pneumatically, hydraulically, or electro-mechanically driven, and typically require substantial operating current and/or voltage. Installation of such a device can include substantial modification to the door, the doorframe, and indeed the structure wherein the door and doorframe are mounted. Installation of such an operator is also expensive and generally requires a skilled professional technician installer. In addition, conventional door operators often are expensive to maintain.

Most door operators are also large, bulky units that employ high torque, low rpm electric motors that require at least a minimal amount of gear reduction. Motors of this type are typically large when compared to high rpm motors of equivalent horsepower due to the large size of the magnets necessary to generate such a high torque at a low rpm. Often, these bulky door operators are too large to mount directly to the door and must be mounted on or above the door lintel. This may decrease the overall aesthetic appeal and, without substantial structural modification, may preclude installation and operation of the unit altogether. For example, in a retrofit installation where the upper portion or edge of the door is at or very near the ceiling, the amount of space provided between the door lintel and the ceiling may be insufficient to mount the unit.

With the advent of in-home voice activated computer personal assistants such as Amazon Echo® and Google Home®, a multitude of devices for automating various home functions have been developed. Collectively these devices are referred to as "Smart Home Devices." Thermostats, electrical outlets, doorbells, security cameras, window blinds and home appliances such as refrigerators as well as door locks and garage doors may all now be integrated into a smart home and controlled via a smart phone app, a computer, wireless Internet connections and personal home assistants. One area that has been overlooked are internal doors in a home or office space. While doors may be automatically locked and unlocked, there is a dearth of mechanisms for reliably opening and closing a typical door using only a voice command.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a device for reliably opening and closing a typical door that may be integrated into a smart home and easily installed on any door.

BRIEF SUMMARY OF THE INVENTION

Disclosed is an automated door closing apparatus.

In one embodiment, the apparatus includes an automated roller case affixed to the bottom of a door. The roller is housed within the automated roller case aligned perpendicularly to the width of the door. The case also houses a motor for actuating the roller, a power supply for the motor, and a microcontroller including a wireless interface module connectable to a smart home system.

The automated door closing device may also include an inductive charger on the outside of the automated roller case and a complementary inductive charging source plate aligned with an flush against the inductive charger on the outside of the automated roller case when the door is in the closed position. A door stop extends from the automated roller case opposite to the door to which the roller case is affixed. A plurality of cleats for engaging carpeting may also be included on the roller. The microcontroller may include a limit switch that monitors the efficiency of the motor and turns off the motor when the roller has ceased to rotate.

In another embodiment, the door operator is incorporated into the bottom of a door, and a kickplate serves as the protective case. The roller is spherical and is rotatable from a retracted position inside the door to an extended position engaged with the floor beneath the door. A pneumatic cylinder or other mechanism rotates or translates the roller between the retracted and extended positions.

In another embodiment, the door operator having an automatic roller comprises a roller engaged with a floor underneath a door. The door rotates about a door hinge attached to a doorjamb of a doorway, and the roller has an axis of rotation substantially parallel to a width of the door and coplanar with an axis of rotation of the door hinge. A protective roller case at least partially encloses the roller and is attached to the door. A motor regulated by a microcontroller rotates the roller about the roller's axis of rotation. The door rotates to a closed position when the roller rotates in a first direction, and translates to an open position when the roller rotates in a second, opposite direction. The roller translates between an extended position engaged with the floor and a retracted position disengaged from the floor.

In another embodiment, a door attachment plate removably attaches the protective roller case to an exterior wall of the door. The automated door closing device includes a door stop extending from the automated wheel case opposite to the door to which the wheel case is affixed. The wheel further has a plurality of cleats for engaging carpeting. The microcontroller includes a limit switch that monitors the efficiency of the motor and turns off the motor when the wheel has ceased to rotate.

It is therefore an object of the present invention to provide an automated door closing apparatus such as a door operator having an automatic roller integrated into a smart home and retrofitted onto existing doors.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
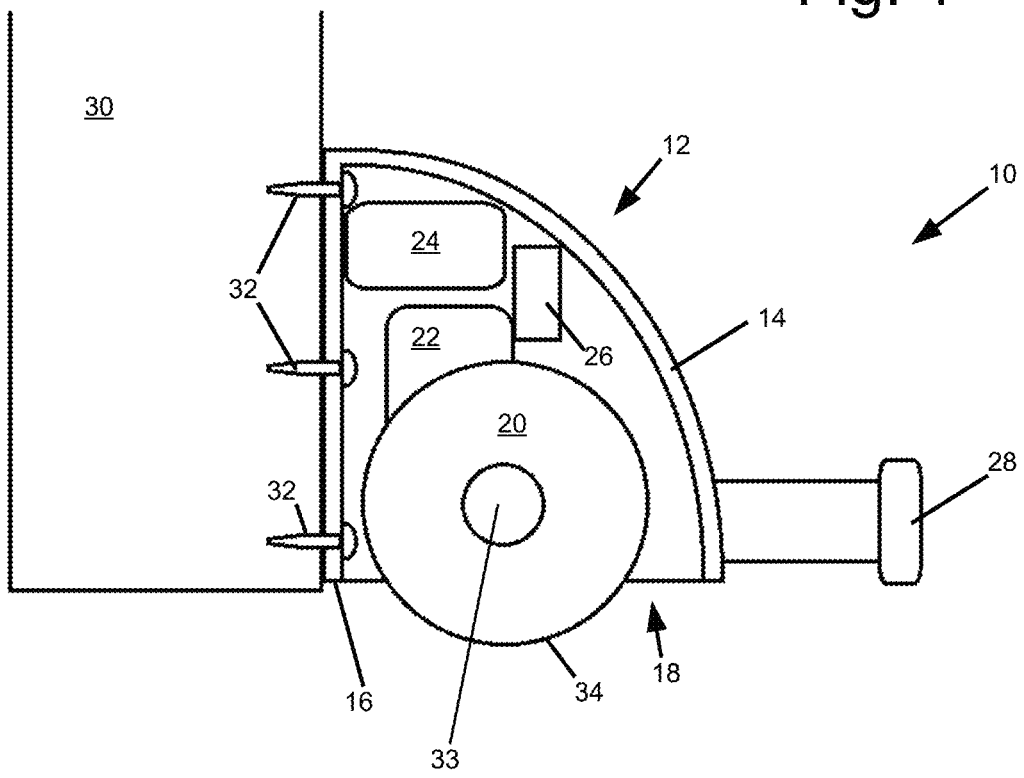
FIG. 1 is a cutaway side view of a door operator having an automated roller in accordance with the principles of the invention.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. The term "roller" is used throughout to refer to mechanisms utilized to converts rotational motion to linear motion, for example a wheel. However, it should be understood that the "rollers" of the present invention may have any of a variety of shapes, for example cylindrical, spherical, frustoconical, and toroidal rollers are generally all suitable for use in the invention. "Rollers" should be interpreted broadly to refer to any device for converting angular momentum into linear momentum and may therefore include more complicated rollers such as sprocket driven belts similar to tank treads or other devices, unless it is clear from the context that a more specific meaning is intended.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Various embodiments of the disclosure could also include permutations of the various elements recited in the claims as if each dependent claim was a multiple dependent claim incorporating the limitations of each of the preceding dependent claims as well as the independent claims. Unless explicitly stated otherwise, such permutations are expressly within the scope of this disclosure. Similarly, the embodiments shown and described herein include elements that perform the same or similar functions but are distinct and one or more ways from each other. Unless explicitly stated otherwise, elements of one embodiment be replaced with one or more similar elements from a different embodiments. For example, some embodiments disclose a spherical roller while other embodiments disclose a cylindrical roller. Unless expressly stated otherwise, it should be understood that these different types of rollers are interchangeable between embodiments and that all such permutations are within the scope of this invention. As an additional example, inductive charging plates disclosed in one embodiment should be understood as components that could be added to other embodiments that do not expressly include inductive charging plates. These are only two examples, and those skilled in the art will appreciate that these various features may be mixed and matched among the various embodiments shown herein.

Disclosed is door operator having an automated roller for automatically closing and opening a door, which may be programmed and/or operated remotely for example as a components of a smart home or office. The device includes a motorized roller affixed to the bottom of the door and integrated into a smart home environment.

FIG. 1 shows a door operator 10 having an automated roller 20 in accordance with principles of the invention. The door operator is contained within a protective roller case 12 which houses the entire apparatus. The roller case 12 is formed by an outer wall 14 which attaches to a door attachment plate 16 and is at least partially open at the bottom 18. The roller 20 is powered by a motor 22 housed within the roller case 12. A power supply, in this embodiment a rechargeable battery 24, is also housed within the protective roller case 12. A microcontroller 26, also inside the protective roller case 12, has a wireless interface module providing a wireless and/or Bluetooth® connection. A door bumper 28 extends outward from the case 12 in a direction opposite to the door 30.

The roller case 12, along with the components it houses, is removably affixed to the door attachment plate 16, which is affixed to the door 30 by screws 32. This embodiment of a door operator 10 is thus easily retrofitted onto existing doors. The doorstop 28 may be a typical doorstop formed from a metal spring with a rubber end or may optionally have another design such as a telescoping bumper. The roller 20 may include a rubberized exterior wall 34 to improve traction on solid surfaces such as wood or tile. Optionally, the exterior wall 34 of the roller 20 may include cleats, nodules, tread or other similar surface features to better engage carpeting or other surfaces.

Figure 2:
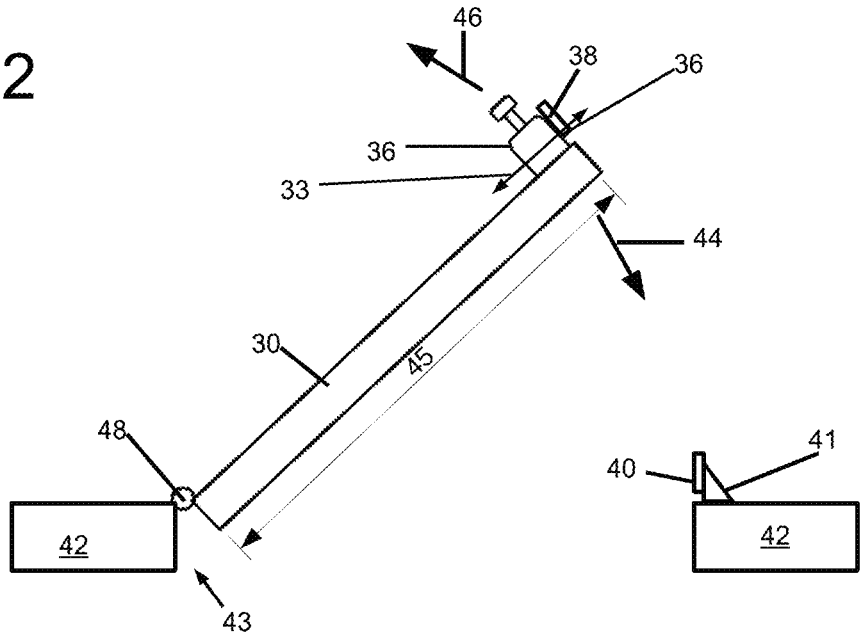
FIG. 2 is an environmental top plan view of a door operator having an automated roller in accordance with the principles of the invention.

As best seen in FIG. 2, the protective roller case 12 may have a substantially rectangular shape when viewed from above or below, having two sidewalls 36. One of the sidewalls may include an inductive charger 38 complementary to an inductive charging source plate 40 affixed to a wall 42 adjacent to the door's frame by a bracket 41. The door 32 to which the door operator 10 is attached is itself attached to a doorjamb 43 of wall 42 by a hinge 48. The hinge 48 defines an axis of rotation about which the door 30 rotates. When the door 30 rotates in direction 44 to a position flush with and coplanar with the wall 42, the door 30 is in the closed position. When the door 30 rotates in direction 46 out of the plane defined by the wall 42 to a predetermined maximum angle of rotation it is in the open position. The angle of rotation is defined such that the closed position represents 0° rotation of the door 30. The open position can be as much as about 170° or about 90°, roughly perpendicular to the wall 42. Regardless of the angle of rotation of the door 30, the angle of rotation 33 of the roller 20 remain substantially parallel to the width 45 of the door 30 and substantially coplanar with the axis of rotation defined by a hinge 48. When the angle of rotation 33 of the roller 20 is fixed, it is actually slightly skew to planes parallel to the axis of rotation of the hinge 48. Door operator 230, shown in FIGS. 13-15 and explained below, actually allows the axis of rotation of the roller to be adjusted such that it is precisely coplanar with a playing through a door hinges axis of rotation.

When the door 30 is in the closed position, the inductive charger 38 and the inductive charging source plate 40 align and lie flush against each other, thereby allowing the rechargeable battery 24 to receive a charge. When the door operator 10 is actuated, it rotates the door 30 in either a closed direction 44 or an open direction 46. It may be desirable to synchronize the door operator 10 with a door latch opening and closing apparatus in order to allow the apparatus 10 to open a door 30 from a fully closed and latched configuration. The invention may optionally include a transmission or clutch mechanism to disengage the motor 22 from the roller 20 when not in use to allow manual opening and closing of the door 30 without resistance. The device may optionally disengage the motor 22 from the roller 20 whenever the device 10 is inactive. Those skilled in the art will appreciate that the inductive charger 38 in the inductive charging plate 40 may optionally be positioned in the door jam between the door 30 and the wall 42. Optionally, the motor 22 may operate as a servo motor, preventing rotation of the roller 20 when the motor 22 is not actuated. This allows the door operator 10 to also serve as a doorstop, securing the door 30 at a desired position, preventing rotation about the hinge 48.

When the door operator 10 is integrated into a smart home, a user may simply utter a voice command which is then received and interpreted by a home assistance system which then actuates the door operator 10. For example, the door operator 10 may be attached to a door to a home office. When the user of the home office desires privacy or to block noise from other regions of the home, he or she may simply say "Alexa, close my office door." An Amazon Echo® device will receive the user's command and close his or her office door without requiring the user to get up and walk over and manually close a door.

The door closing and opening apparatus of the present invention is shown in the Figures as being affixed to the side of a door that swings outward and is hidden when a door is fully opened, not the side of the door facing the door frame when in the open position. This may generally be preferred because it is the side of the door hidden when the door is open and is therefore less likely to be accidentally impinged upon by people or objects moving through the doorway. Optionally, the door operator may be positioned on the other side of the door. The door operator 10 is also shown affixed to a distal end of a door opposite to hinges 48. This generally reduces the amount of force required to move the door. Optionally, the door operator may be positioned at any point along the door.

Figure 3:
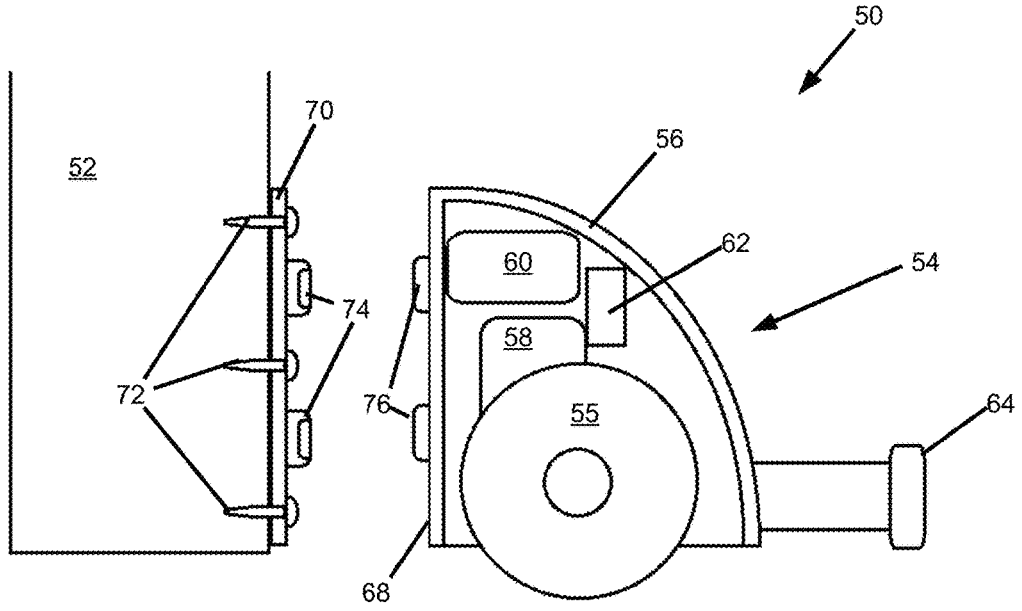
FIG. 3 is a cutaway side view of an alternative embodiment of a door operator having an automated roller in accordance with the principles of the invention.

FIG. 3 shows an alternative embodiment of a door operator 50 in accordance with the principles of the invention. The door operator 50 is attached to a door 52 and has an automated roller case 54 housing a roller 55 attached to a motor 58 and powered by a rechargeable battery 60. A microcontroller 62 controls the door operator 50. The various components are all housed within the protective automatic roller case 54 defined by an outer wall 56 and an attachment plate 68. The outer wall 56 optionally includes a doorstop 64. The attachment plate 68 is configured to lie flush against and coextensive with a door mounting plate 70. The door mounting plate 70 includes screws 72 for securely holding the mounting plate 70 to the door 52 to which it is attached. The door mounting plate 70 includes two hooks 74. Attachment points 76 on the attachment plate 68 align with and are complementary to the hooks 74 such that the attachment points 76 and the hooks 74 form a secure fastener that holds the roller case 54 securely to the door 52, but also provides relatively easy and quick detachment from the door 52.

Figure 4:
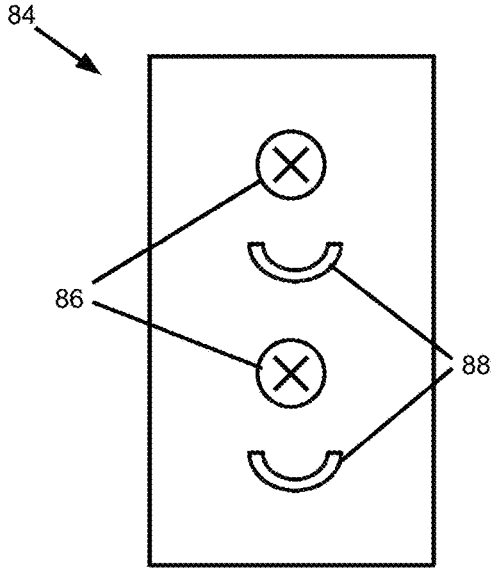
FIG. 4 is a front plan view of a mounting plate for a door operator having an automated roller in accordance with principles of the invention.
Figure 5:
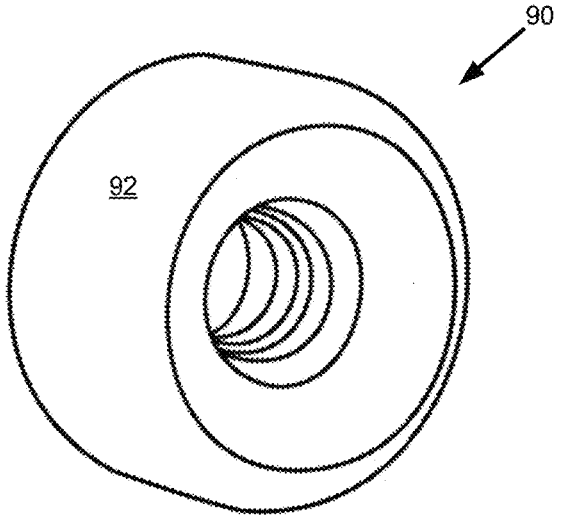
FIG. 5 is a perspective view of a roller for a door operator having an automated roller in accordance with principles of the invention.

FIG. 4 shows an alternative embodiment of a mounting plate 84 affixed to the side of a door to facilitate attachment of a roller case. The mounting plate 84 has two mounting screws 86 and two hooks 88 for attaching a roller case. FIG. 5 shows an exemplary roller 90 for use with the invention. Roller 90 is a typical rubberized roller-skate roller. The rubberized outer surface 92 of the roller 90 provides sufficient static friction to allow the door closing apparatus to function properly.

Figure 6:
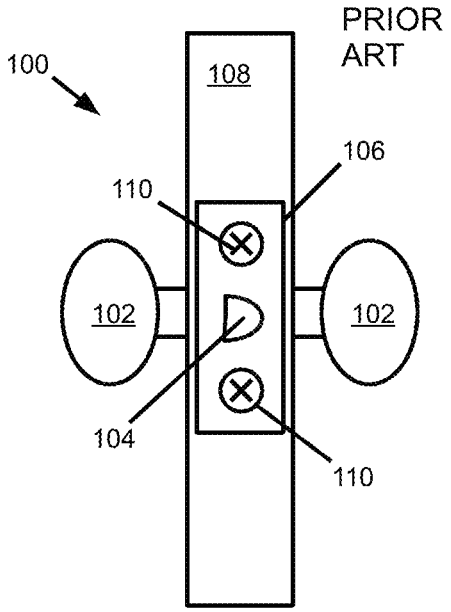
FIG. 6 is a front plan view of a door latching mechanism of the prior arts in accordance with principles of the invention.
Figure 7:
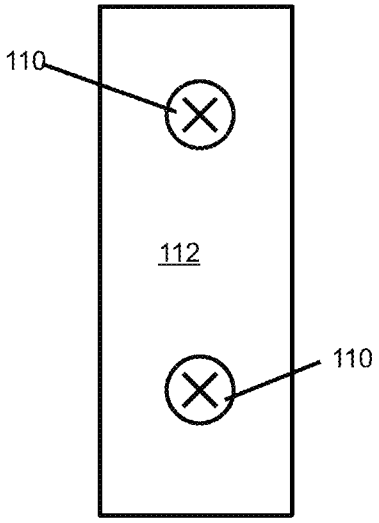
FIG. 7 is a front plan view of a solid plate for a door operator having an automated roller in accordance with principles of the invention.
Figure 8:
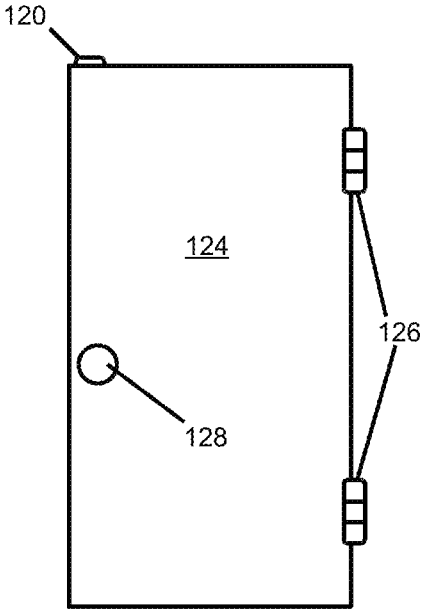
FIG. 8 is a front plan view of a door modified for use with a door operator having an automated roller in accordance with principles of the invention.
Figure 9:
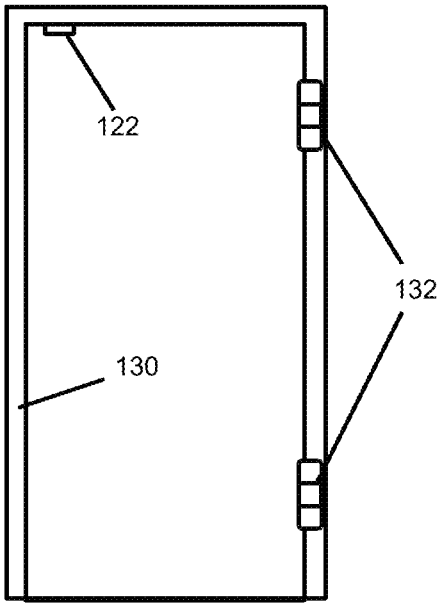
FIG. 9 is a front plan view of a doorframe modified for use with a door operator having an automated roller in accordance with principles of the invention.

The door closing apparatus in accordance with principles of the invention may be employed with additional devices to provide a door that both opens and closes on its own. These additional devices are shown in FIGS. 7-9. FIG. 6 shows a typical door latch mechanism 100. Each of two knobs 102 may be used to extend or retract a bolt 104 that extends through a bolt plate 106 secured to the door 108 by two screws 110. To modify such a typical door, the bolt plate 106 is replaced with the solid plate 112 shown in FIG. 7. The bolt 104 and/or the entire latch mechanism may be removed from a door. Optionally, the solid plate 112 is affixed over the bolt 104 and the entire latch mechanism, thereby holding the bolt 104 in the retracted position permanently. By preventing the bolt from securing a door in a closed position, the automated door closing device in accordance with the principles of the invention may easily both open and close doors to which they are attached.

Because the bolt is removed or permanently retracted, the door is not restrained when in the closed position. To overcome this, the present invention utilizes a pair of magnetic plates 120 and 122 to hold a door in a closed position. FIG. 8 shows a door 124 having two hinges 126 and a handle 128. At the top of the door, a magnetic plate 120 is affixed. FIG. 9 shows a door frame 130 having hinges 132 to which a second magnetic plate 122 has been affixed. When the door 124 closes in the door frame 130, the magnetic plates 120 and 122 align and hold the door in place due to magnetic force. The automated door closing device in accordance with the principles of the invention applies sufficient force to overcome the magnetic attraction between the plates 120 and 122 so that it may be open and closed freely using only the device.

Figure 10:
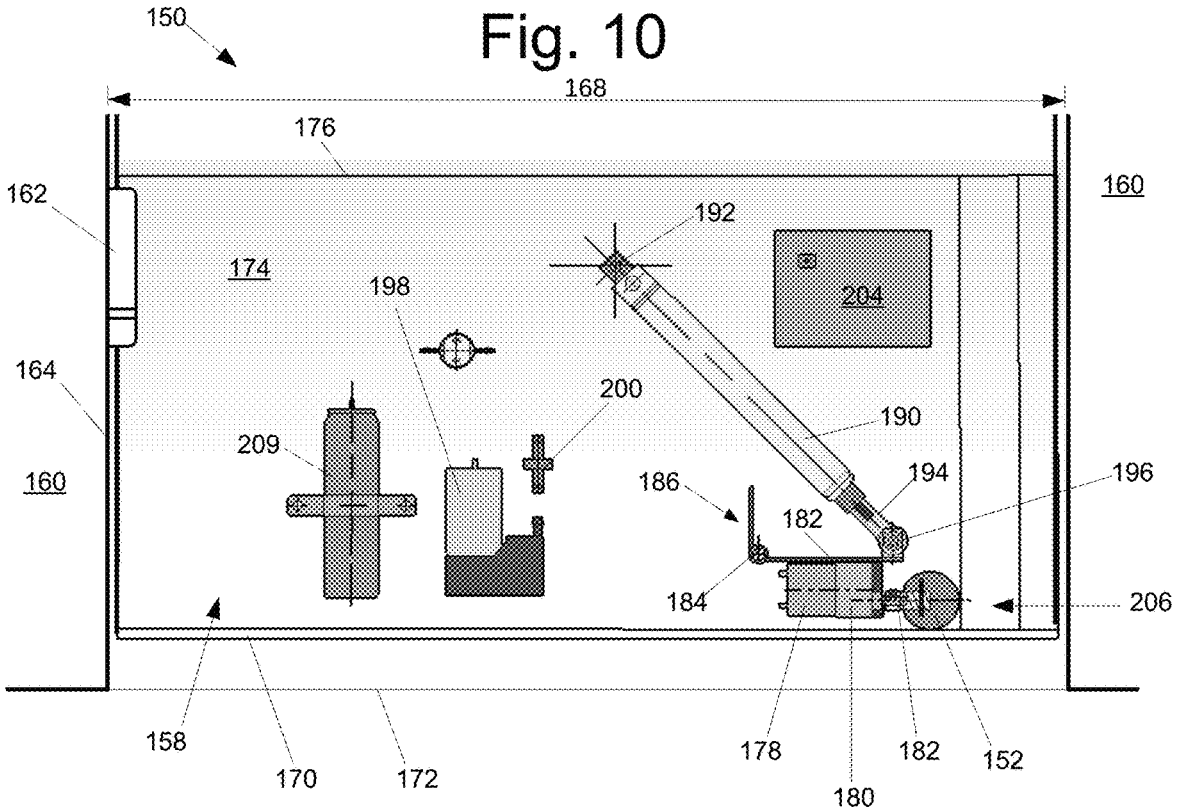
FIG. 10 is a cross-sectional view of an alternative embodiment of a door operator having an automatic roller in a retracted position in accordance with principles of the invention.
Figure 11:
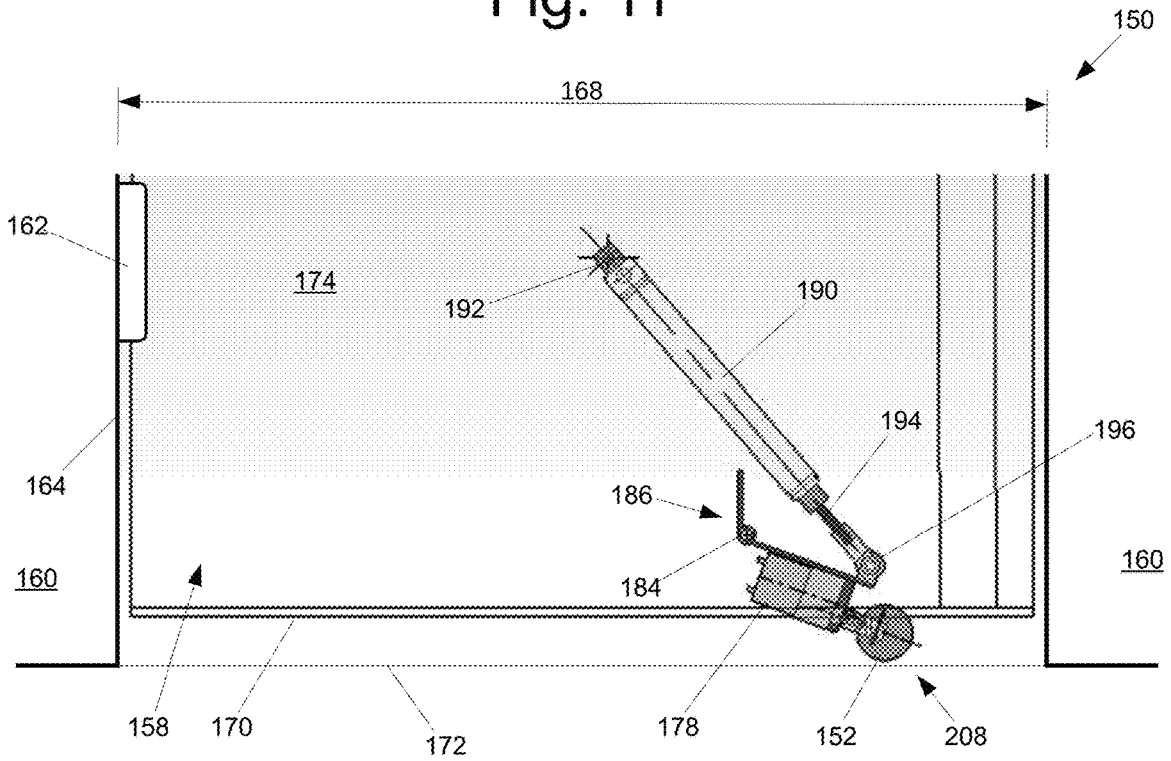
FIG. 11 is a cross-sectional view of an alternative embodiment of a door opener having an automatic roller in an extended position in accordance with principles of the invention.
Figure 12:
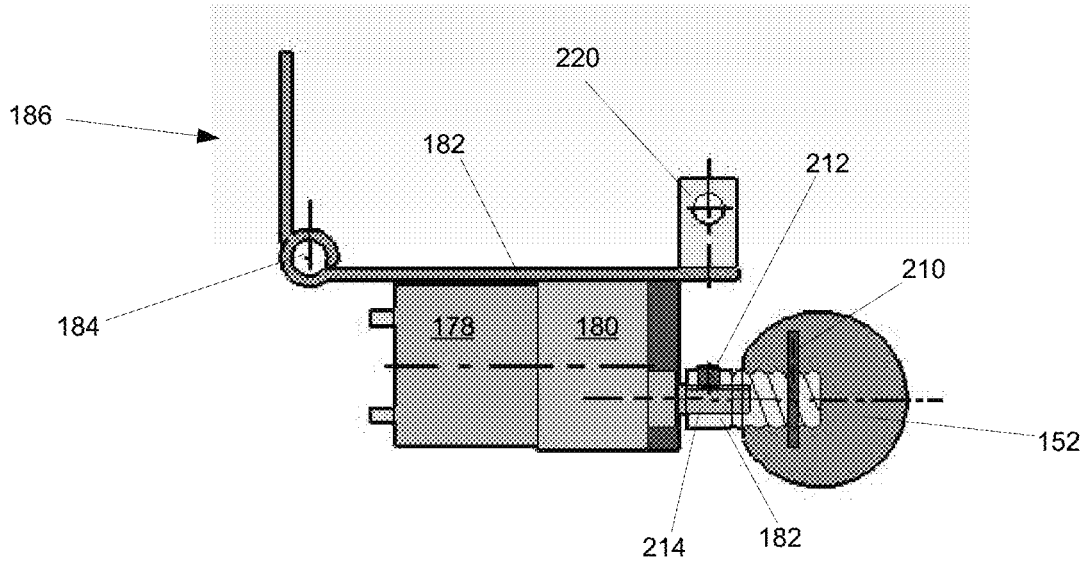
FIG. 12 is an enlarged view of a roller and motor of a door opener having an automatic roller in accordance with principles of the invention.

FIGS. 10-12 show an alternative embodiment of a door operator 150 having an automated roller 152 that is retractable. FIG. 10 shows the door operator 150 in the retracted position 206, and FIG. 11 shows the door operator 150 in the extended position 208. In both FIGS. 10 and 11, the door 158 is in the closed position, lying flush and coplanar with a wall 160. A hinge 162 connects the door 158 to a doorjamb 164 of the doorway 168 in the wall 160. In this embodiment, the door 158 rotates about the hinge 162 as much as 180° relative to the wall 160, from a closed position at 0° to an open position of about 90° or more, relative to the wall. Optionally, the hinge 162 may allow the door to rotate in either direction from the closed position, thus translating between about 170° to about −170°, such as for example swinging doors commonly used for entryways into kitchens. The bottom 170 of the door 158 is suspended above the floor 172 which it does not come into contact with. The distance between the bottom 170 of the door 158 and the floor 172 may vary from door to door. One of the advantages of the door operator 150 shown in FIGS. 10-12 is that it may be installed on any door and begin operation immediately without need for calibrating the door operator 150 according to the distance between the bottom 170 of the door 158 and the floor 172.

In this embodiment, the door operator 150 is mounted on the interior side 174 of a kickplate 176, which is attached to the door 158 having a bottom region that is at least partially hollow to accommodate the components of the door operator 150. The kickplate 176 serves as the protective roller case and is attached to and incorporated into the bottom of a door 158. As a result, the door operator 150 of this embodiment is more discreet and less likely to be damaged. The roller 152 is actuated by a motor 178. A gearbox 180 connects the axle 182 of the roller 152 to the motor 178. The roller 152 is substantially spherical which allows it to engage a floor beneath the door without requiring precise measurement of the distance between the floor and the retracted position of the roller 152. So long as the door operator 150 is capable of extending the roller the distance from the bottom 170 of the door and the floor 172, the spherical roller 152 when not only engage the floor 172 but will also rotate the door 158 about the hinge 162. Those skilled in the art will appreciate that this simplifies installation and use of the door operator 150.

The both the roller 152 and the motor 178 which actuates the roller are mounted on a plate 182 which rotates about a pivot pin 184 of a hinge 186. The pivot pin 184 of the hinge 186 is perpendicular to the kickplate 176, allowing the mounting plate 162 to rotate upward and downward relative to the hinge 186. A pneumatic cylinder 190 extends from an anchor point 192. The actuating rod 194 extends out of the pneumatic cylinder 190 and is attached at its distal end 196 to the plate 182. A compressor 198 regulates air pressure inside the pneumatic cylinder 190 to extend or retract the actuating rod 194. An air filter 200 is attached to the air inlet 202 of the compressor 198. A microcontroller 204 regulates both the motor 178 and the compressor 198. Either or both of the motor 178 in the compressor 198 may operate as a servo mechanism, that is, positive feedback may be utilized to regulate their actuation.

To rotate the roller 152 from the retracted position 206 to the extended position 208 shown in FIG. 11, the compressor 198 forces air into the pneumatic cylinder 190, causing the actuating rod 194 to extend, which in turn rotates the plate 182 downward. When the microcontroller 204 determines that the roller 152 has been extended sufficiently to properly engage the floor 172, it shuts the compressor 198 off. To achieve this, the microcontroller 204 may be programmed to shut off the compressor 198 when it receives a signal from a sensor indicating that a predetermined maximum air pressure has been attained within the pneumatic cylinder 190. Optionally, the microcontroller 204 may determine that the roller 152 has been sufficiently extended when the voltage required by the compressor to continue increasing air pressure within the cylinder 190 reaches a predetermined value. Optionally, the microcontroller 204 may use a variety of other sensors to determine when the roller 152 has been sufficiently extended to engage the floor 172.

A buffer tank 209 may also be placed in fluid communication with the pneumatic cylinder 190 to accommodate modulations in internal air pressure of the cylinder 190 as the door 158 rotates about the hinge 162. For example, there may be dips, bumps, other imperfections or minor obstacles on the floor 172. The use of a buffer air tank 209 also allows the door operator 152 function in the presence of a doorjamb on the floor 172 or across a slanted or otherwise uneven floor. By incorporating the buffer tank 209, the roller 152 may traverse an uneven surface more easily. The microcontroller 204 may continuously monitor the air pressure within the cylinder 190 and reactivate the compressor 198 as necessary to maintain a minimum air pressure. By maintaining constant air pressure within the cylinder 190, the microcontroller 204 ensures that the roller 152 engages the floor 172 sufficient force to efficiently rotate the door 158 about the hinge 162. Sensors may also be used to detect when the door 158 has been rotated to a predetermined position and provide this information to the microcontroller 204 which may then retract the roller 152 back into the retracted position 206 by reversing airflow through the compressor 198 until the actuating rod 194 is sufficiently retracted into the cylinder 190.

The pneumatic cylinder 190 may optionally be replaced with a hydraulic cylinder or other mechanisms, such as for example a servo motor, for raising and lowering the roller 152. However a pneumatic cylinder 190 is generally preferred to a hydraulic cylinder because it may use the ambient air, as opposed to a hydraulic cylinder which would require additional components to manage the fluid. In this embodiment, the pneumatic cylinder 190 is oriented approximately 45° relative to the floor 182 when in the roller 152 retracted position 206. Those skilled in the art will appreciate that the pneumatic cylinder 170 may be oriented in a variety of different configurations so long as it is capable of rotating the plate 182 two rotate the roller 152 between the retracted an extended positions 206 and 208, respectively.

As mentioned above, the motor 178 may also act as a servo, such that it automatically shuts off when the voltage attains a predetermined value, indicating that the door 158 has reached a maximum degree of rotation in a particular direction. The present invention may also optionally include a sensor 210 attached to the hinge 162 which detects the angle between the door 158 and the wall 160. The microcontroller 204 may be configured to automatically stop at various predetermined angles. For example, the microcontroller 204 may be programmed to cease rotating the door when it has reached a closed position, defined as the door 158 being flush with the wall 160, or when it has reached a maximal open position, for example defined as the door 158 being perpendicular to the wall 160.

Optionally, the door operator 150 may be used to secure the door 158 in a particular orientation by extending the roller 152 into the extended position 208 engaging the floor 172, and using the motor 178 to prevent rotation of the roller 152. The door operator 150 thus acts as a doorstop, holding the door 158 in a fixed position. The microcontroller 204 of the door operator 150 may be preprogrammed or controlled in real time by connecting it to a wireless or directly wired network. In this embodiment, an external power supply provides power to the door operator 150.

FIG. 12 shows the roller 152 in greater detail. A linchpin 210 secures the axle 182 to the roller 152. A setscrew 212 secures the shaft 214 extending from the gearbox 180. The distal end 196 of the actuating rod 194 is pivotally attached to connector 220 on the rotating plate 182. The spherical roller 152 may optionally be replaced with a disc shaped or ovoid roller. However, the spherical roller typically maximizes efficiency over a range of distances between the retracted an extended positions. In addition, the roller 152 and motor 178 may optionally be attached to a sliding rail instead of a rotating hinge. If the roller 152 and motor 178 are extended and retracted by translation in a purely vertical direction, a disc shaped or cylindrical roller may be almost as or equally efficient as using a spherical roller.

Figure 13:
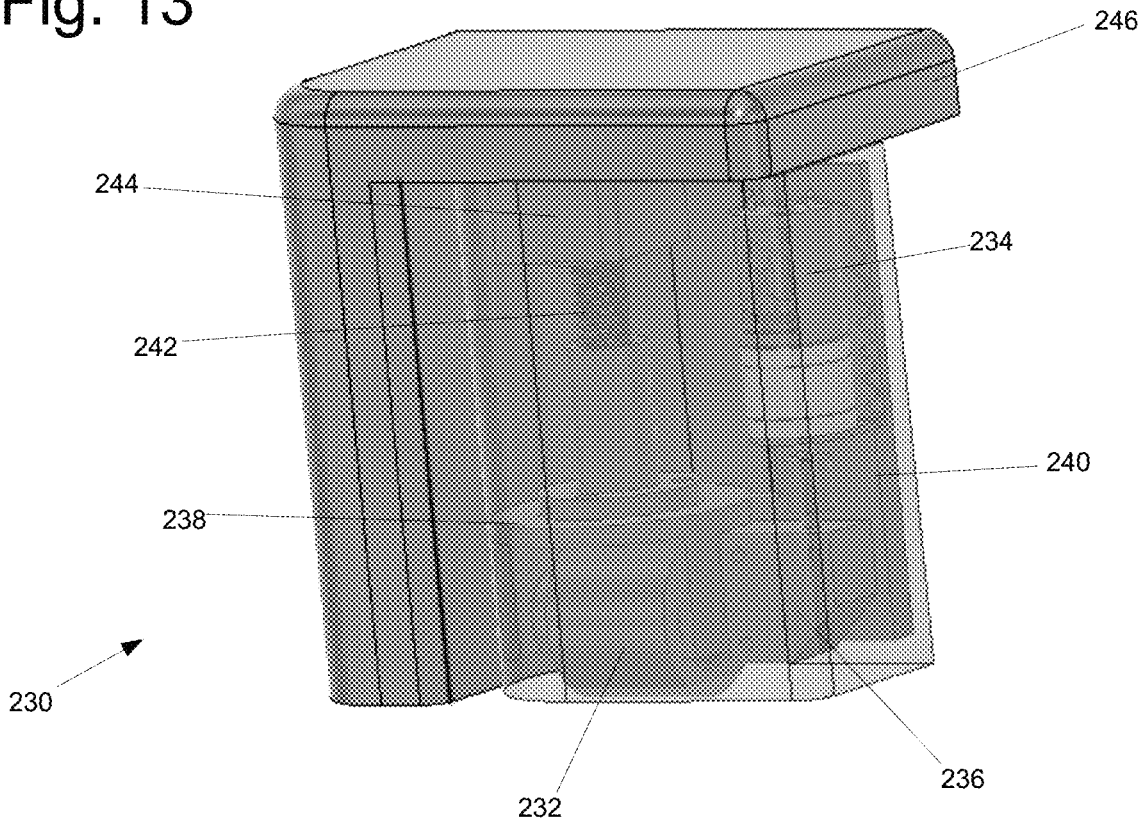
FIG. 13 is a perspective view of another alternative embodiment of a door opener having an automatic roller in accordance with principles of the invention.
Figure 14:
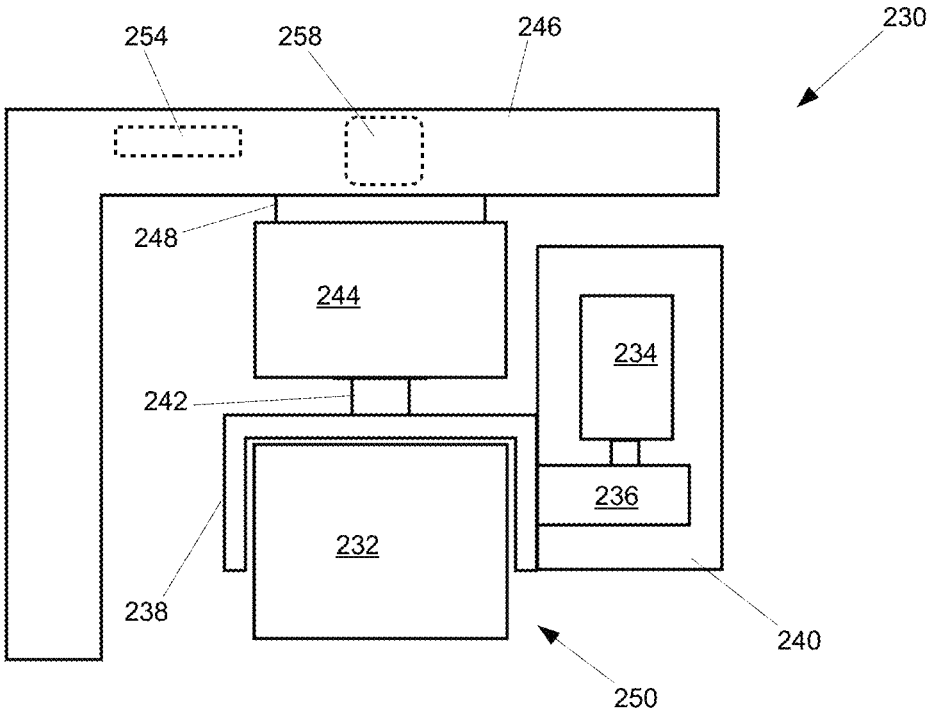
FIG. 14 is a side elevation view of another alternative embodiment of a door opener having automatic roller in a retracted position in accordance with principles of the invention.
Figure 15:
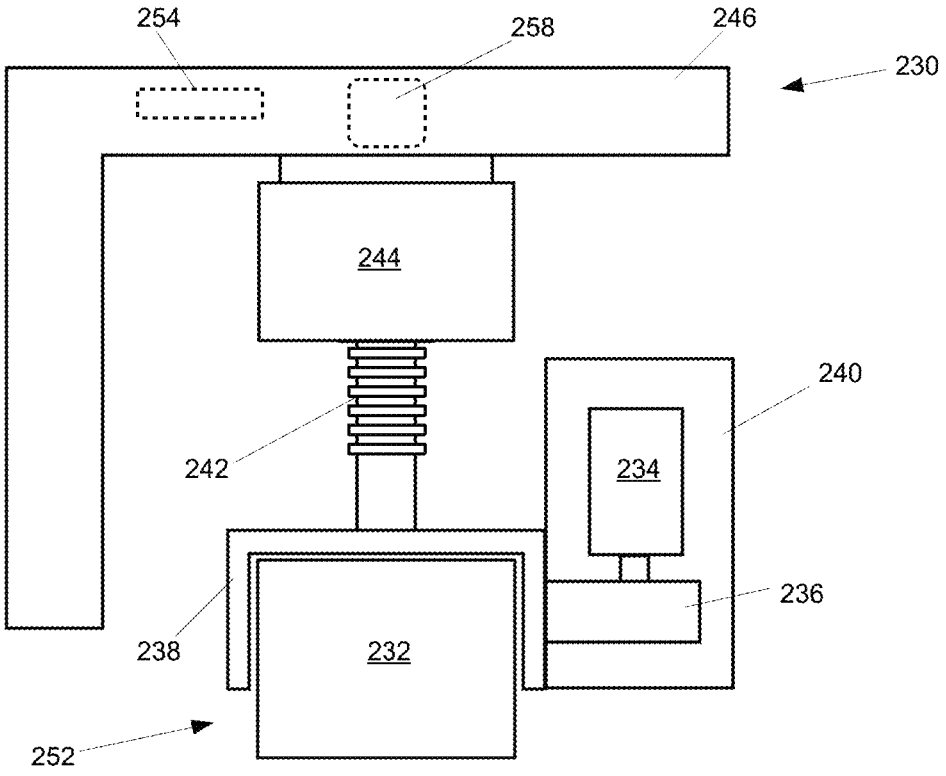
FIG. 15 is a side elevation view of another alternative embodiment of a door opener having an automatic roller in an extended position in accordance with principles of the invention.

FIGS. 13-15 show another alternative embodiment of a door operator 230 having a retractable roller 232. In this embodiment, the roller 232 is cylindrical and is attached to a motor 234 by a gearbox 236. The bracket 238 for the roller 232 is attached to a mounting plate 240 on which both the motor 234 and the gearbox 236 are mounted. A worm shaft 242 connects the bracket 238 for the roller 232 to a worm drive 244 which raises and lowers the roller 232. The worm drive 244 is in turn connected to the protective roller case 246 by a rotatable shaft 248. FIG. 14 shows the roller 232 in the retracted position 250 and FIG. 15 shows the roller 232 in the extended position 252. A microcontroller 254 raises and lowers the roller 232 by actuating the worm drive 244. The microcontroller 254 also uses a servo motor 258 to rotate the worm drive 244, roller 232 and motor 234. The protective roller case 246 of this embodiment attaches to the exterior of the door in a manner similar to that shown for door operator 10 in FIGS. 1-3. Because the roller 232 is rotatable, the orientation of the rollers axis of rotation may be altered relative to the door to which it is attached. This allows the axis of rotation of roller 32 to be precisely aligned so that it is precisely coplanar with axis of rotation of a door hinge. Those skilled in the art will appreciate that this will improve the efficiency door operator, minimizing force required to rotate the door.

Figure 16:
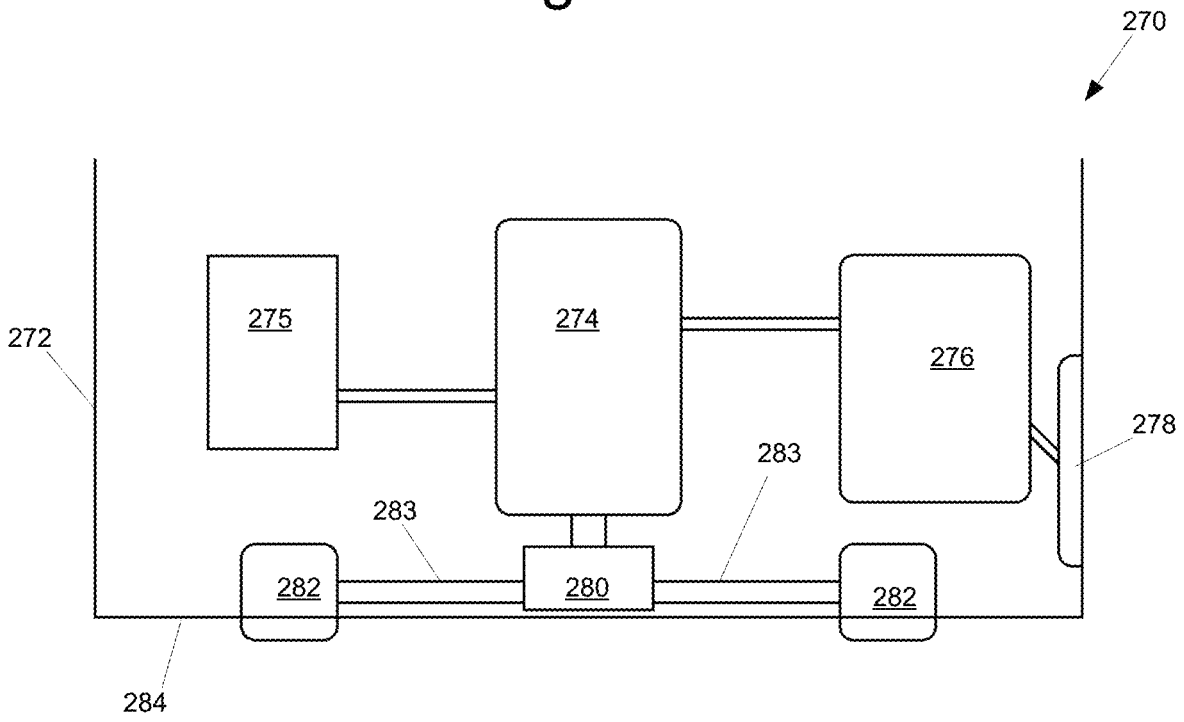
FIG. 16 is a cross-sectional view of another alternative embodiment of a door opener having an automatic roller in accordance with principles of the invention.

FIG. 16 shows another alternative embodiment of a door operator 270. Door operator 270 is located inside a door 272, which serves as the protective roller casing. A motor 274 is controlled by a microcontroller 275 and is powered by a battery 276 which is connected to an inductive charger plate 278 which can be used to recharge the battery 276. The motor 274 is attached to a differential joint 280 which is connected to and rotates two rollers 282 via two axles 283, which partially extend downward through the bottom 284 of the door 272. In this embodiment, the rollers 282 do not retract and must be adjusted during installation to ensure that they adequately engage a floor beneath the door 272. The differential joint 280 allows each of the rollers 282 to spin at different rates. This is important when the door rotates out word or inward because each of the rollers 282 will travel different distances.

Figure 17:
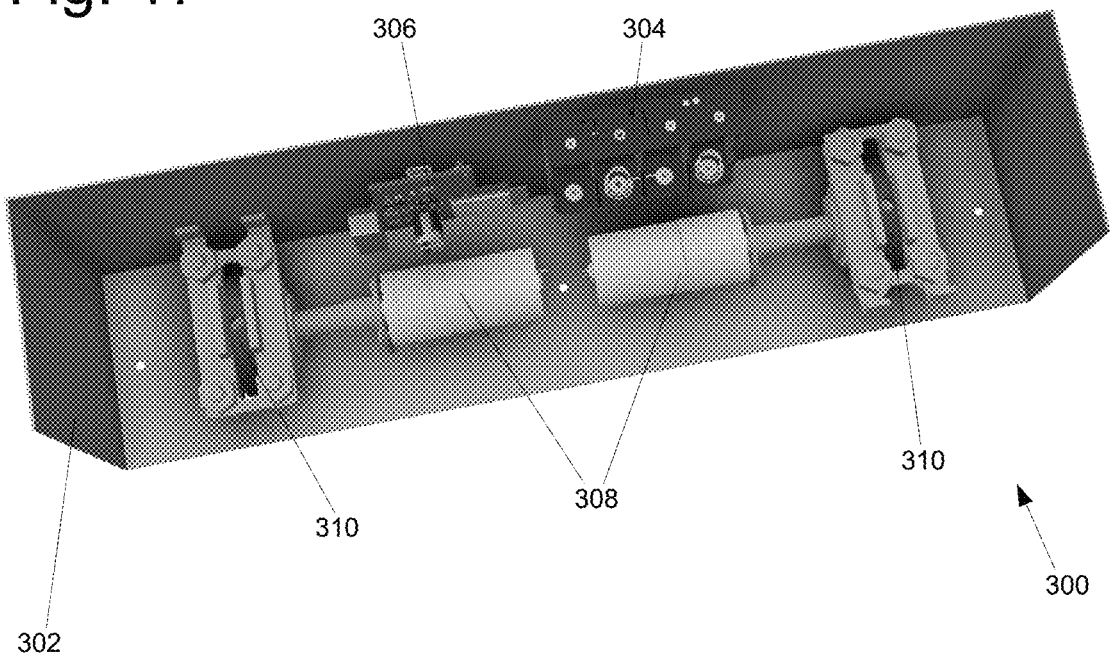
FIG. 17 is a top perspective view of another alternative embodiment of a door opener having an automatic roller in accordance with principles of the invention.
Figure 18:
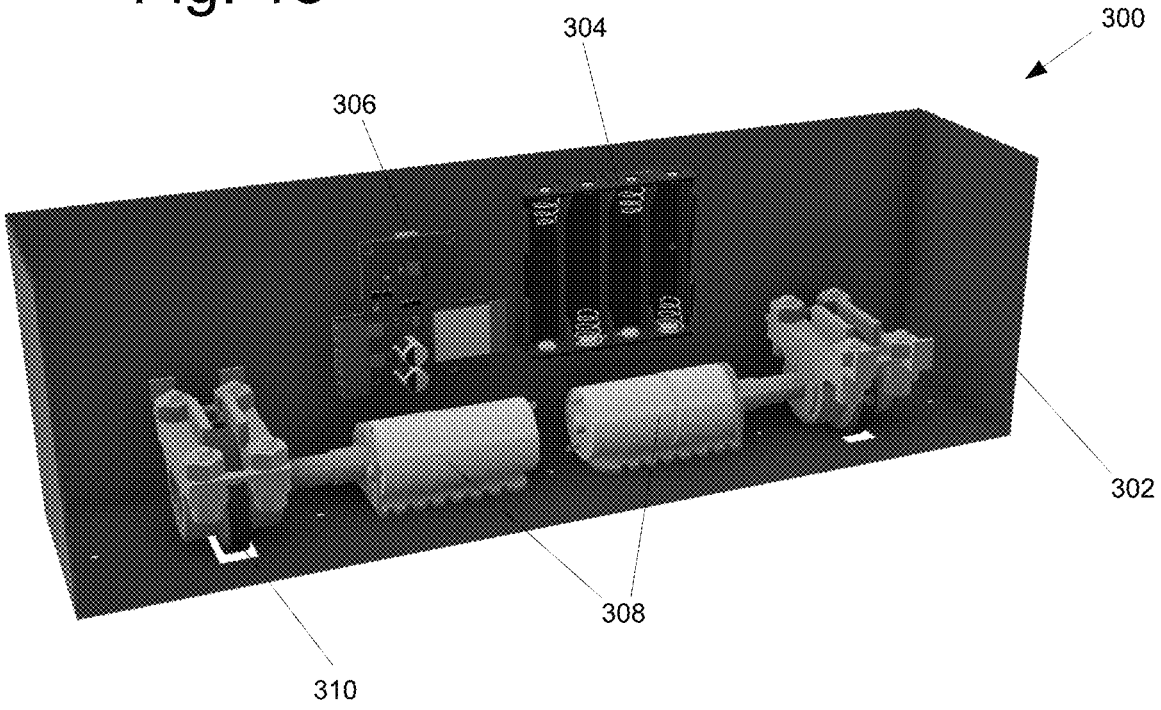
FIG. 18 is a side perspective view of another alternative embodiment of a door opener having an automatic roller in accordance with principles of the invention.
Figure 19:
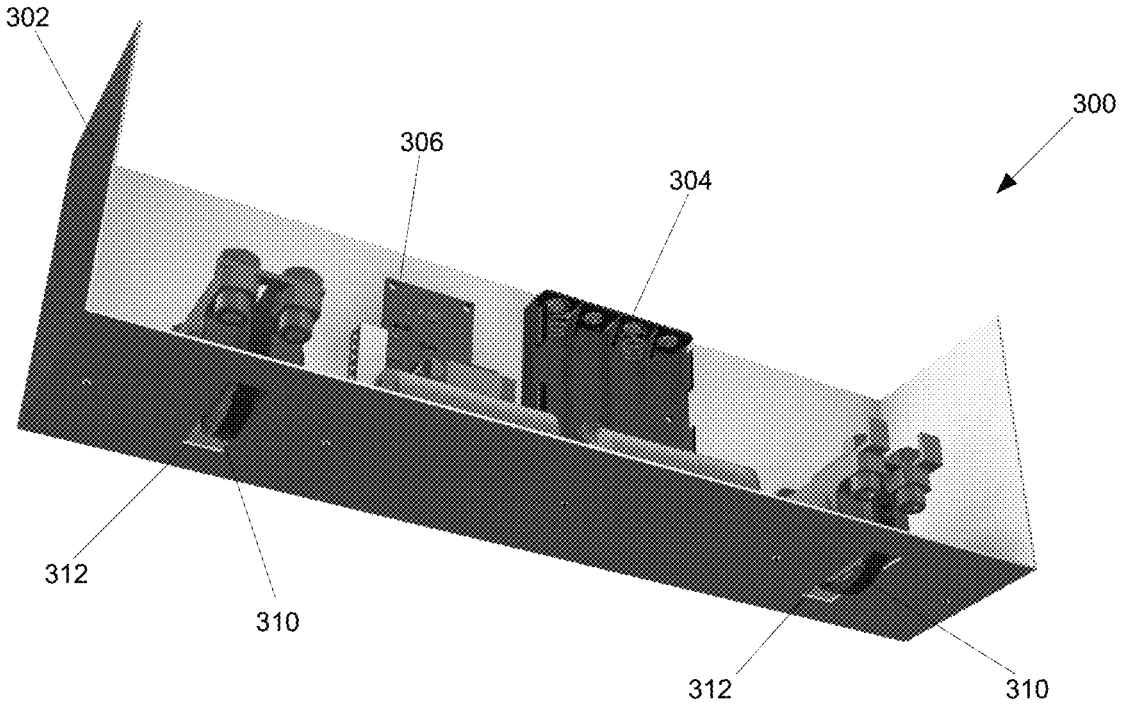
FIG. 19 is a bottom perspective view of another alternative embodiment of a door opener having an automatic roller in accordance with principles of the invention.

FIGS. 17-19 show another alternative embodiment of a door operator 300. The door operator 300 may be located either entirely or partially within the bottom of a door. The various components are mounted on a protective roller case 302 which is open at the top. Either rechargeable or disposable batteries may be inserted into the battery holder 304 and provide power to the door operator 300. A microcontroller 306 controls the motors 308. Each of the motors 308 rotates a separate roller 310. Each of the rollers 310 partially extend downward out of the slots 312 and engage a floor underneath a door. This embodiment provides more power to the rollers because it uses two motors.

The microcontrollers of the various embodiments are all capable of being preprogrammed or receiving instructions in real time, such as for example voice commands using a "smartphone" network system. They are also capable of utilizing motors and pneumatic cylinders as servos so that a door may be secured in a desired position such as an open position, a closed position or another desired orientation of the door. The rollers of the invention may be cylindrical, disc shaped, spherical conical, frustoconical or have another configuration so long as it is efficient in achieving traction with a floor underneath a door, enabling it to rotate a door about a door hinge. If multiple rollers are used, it is beneficial to allow different rollers to have different angular velocities.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A door operator having an automatic roller comprising:

a roller engaged with a floor underneath a door, wherein the door rotates about a door hinge attached to a doorjamb of a doorway, and the roller has an axis of rotation substantially parallel to a width of the door and coplanar with an axis of rotation of the door hinge;

a protective roller case at least partially enclosing the roller and attached to the door;

a microcontroller inside the protective roller case;

a motor regulated by the microcontroller which rotates the roller about the axis of the roller;

wherein the door rotates to a closed position when the roller rotates in a first direction, and translates to an open position when the roller rotates in a second, opposite direction; and wherein the roller is spherical, and the roller and the motor are attached to a roller hinge, the roller hinge having an axis of rotation substantially perpendicular to both the width of the door and the axis of rotation of the roller.

2. The door operator having an automatic roller of claim 1 wherein the roller Translates between an extended position engaged with the floor and a retracted position disengaged from the floor.

3. The door operator having an automatic roller of claim 2 wherein the protective roller case comprises a planar kickplate, and the retracted position of the roller is inside the door.

4. The door operator having an automatic roller of claim 3 wherein the protective roller casing comprises the planar kickplate and the microcontroller and the motor are located inside the door.

5. The door operator having an automatic roller of claim 4 wherein the roller is spherical, and the roller and the motor are attached to a roller hinge, the roller hinge having an axis of rotation substantially perpendicular to both the width of the door and the axis of rotation of the roller.

6. The door operator having an automatic roller of claim 1 further comprising a pneumatic cylinder having an actuating rod attached to the roller hinge;

wherein the roller and the motor rotate downward about the roller hinge into the extended position when the actuating rod of the pneumatic cylinder is extended, and the roller and the motor rotate upward about the roller hinge upward into the retracted position when the actuating rod is retracted into the cylinder.

7. The door operator having an automatic roller of claim 2 wherein a door attachment plate removably attaches the protective roller case to an exterior wall of the door.

8. The automated door closing device of claim 2 further comprising a door stop extending from the the protective roller case opposite to the door to which the wheel case is affixed.

9. The automated door closing device of claim 2 wherein the roller further comprises a plurality of cleats for engaging carpeting.

10. The automated door closing device of claim 9 wherein the microcontroller includes a limit switch that monitors the efficiency of the motor and turns off the motor when the wheel has ceased to rotate.

* * * * *